US006702593B2

(12) United States Patent
Ogawa

(10) Patent No.: US 6,702,593 B2
(45) Date of Patent: Mar. 9, 2004

(54) CONNECTOR APPARATUS FOR HARDWARE

(75) Inventor: Shinji Ogawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/194,090

(22) Filed: Jul. 11, 2002

(65) Prior Publication Data

US 2003/0017728 A1 Jan. 23, 2003

(30) Foreign Application Priority Data

Jul. 17, 2001 (JP) ..... 2001-216266

(51) Int. Cl.[7] ..... H01R 9/09
(52) U.S. Cl. ..... 439/79
(58) Field of Search ..... 439/76.1, 79, 80, 439/559, 564, 926

(56) References Cited

U.S. PATENT DOCUMENTS 4,676,575 A * 6/1987 Denlinger et al. ..... 439/271
5,263,871 A * 11/1993 Sano ..... 439/157
5,487,680 A * 1/1996 Yamanashi ..... 439/552
5,593,319 A 1/1997 Ohno
5,618,204 A * 4/1997 Nix et al. ..... 439/559
5,879,173 A * 3/1999 Poplawski et al. ..... 439/138
6,036,544 A * 3/2000 Brunker et al. ..... 439/607
6,338,651 B1 * 1/2002 Svette et al. ..... 439/559
6,406,192 B1 * 6/2002 Chen et al. ..... 385/56
6,466,447 B2 * 10/2002 Murowaki et al. ..... 361/752
6,524,119 B2 * 2/2003 Kato et al. ..... 439/79

* cited by examiner

*Primary Examiner*—Javaid H. Nasri
*Assistant Examiner*—Thanh-Tam Le
(74) *Attorney, Agent, or Firm*—Gerald E. Hespos; Anthony J. Casella

(57) ABSTRACT

A connector apparatus includes a relay connector (30) with an outer connector section (33) adapted to engage a mating connector and an inner connector section (34) adapted to engage a PCB connector (20). A printed board (10) with a PCB connector (20) is inserted into a casing (11) so that the PCB connector (20) is inside an attachment hole (18) in the casing (11). The inner connector section (34) of the relay connector (30) passes through the attachment hole (18), enters the casing (11), and engages a hood (22) of the PCB connector (20). The outer connector section (33) extends outwardly from the sidewall (11A).

7 Claims, 6 Drawing Sheets

CONNECTOR APPARATUS FOR HARDWARE

BACKGROUND OF THE INVENTION

1. Field of the Invention

This invention relates to a connector apparatus for hardware in which a connector extends outwardly from a casing.

2. Description of the Related Art

A connector apparatus for hardware in which a connector extends out from a casing is disclosed in, for example, U.S. Pat. No. 5,593,319 and is shown in FIG. 6 herein. FIG. 6 is a perspective view of a conventional connector apparatus for hardware. In this connector apparatus, as shown in FIG. 6, a printed board 2 is accommodated in a casing 1. PCB connectors 3 are attached to an edge of the printed board 2. Fitting ports 4 having hoods 5 are open in a sidewall of the casing 1. The printed board 2 is contained in the casing 1 and the respective PCB connectors 3 are disposed inside the corresponding fitting ports 4 having the hoods 5. A mating connector is inserted into the fitting port 4 to be connected to the corresponding PCB connector. Such connector apparatus is effective in, for example, a simple seal structure.

On the other hand, such a connector apparatus may sometimes have to be made of a metallic material, such as aluminum or the like, to dissipate heat effectively. In particular, portions of the fitting ports 4 having the hoods 5 cannot be formed integrally from a synthetic resin material, and must be formed by a machining process. This makes it difficult to produce the casing 1. Even if the casing 1 is formed by die-casting, it is necessary to finish inner surfaces of the hoods 5 into smooth planes by a secondary working, since the inner surfaces of the hoods 5 may serve as seal surfaces. This is troublesome.

It is also difficult to align the centers of the respective PCB connectors 3 accurately with the centers of the corresponding fitting ports 4. Consequently, the PCB connector cannot fit a mating connector regularly. The worst case will result in contact malfunction between terminals.

SUMMARY OF THE INVENTION

In view of the above problems, an object of the present invention is to provide a connector apparatus that simplifies a structure of a casing and interconnects connectors coaxially.

A connector apparatus for hardware according to the invention comprises a casing having an attachment hole in a sidewall thereof. The connector apparatus further includes a hardware side connector having terminals. The hardware side connector is inserted in the casing so as to be disposed inside the attachment hole. A relay connector is provided with relay terminals and has an end with an inner connector section adapted to fit the hardware side connector and has an opposed end with an outer connector section adapted to fit a mating connector. The relay connector can be attached to the sidewall with the inner connector section disposed through the attachment hole in the casing.

The attachment hole of the connector apparatus preferably has enough of a clearance to pass the inner connector section of the relay connector through the hole.

In the assembling process of the connector apparatus, the hardware side connector is contained in the casing that is to be disposed inside the attachment hole. The inner connector section of the relay connector passes through the attachment hole and fits the hardware side connector in the casing. Then, the relay connector is fixed on the sidewall of the casing and the outer connector section of the relay connector fits the mating connector. The terminals in the mating connector are connected through the relay terminals to the terminals in the hardware side connector.

The casing has a simple structure in which only the attachment hole is provided in the sidewall. Thus, the casing can be made of a metallic material, for example, aluminum or the like. Also, the relay terminals of the relay connector are regularly connected to the terminals of the hardware side connector beforehand and the mating connector is coupled to the outer connector section of the relay connector in which the relay terminals are disposed. Therefore, it is possible to interconnect the corresponding terminals of the hardware side connector and mating connector reliably through the relay terminals.

Since it is possible to displace the inner connector section of the relay connector in the attachment hole, it becomes easy to interconnect the hardware side connector and mating connector in the narrow casing.

BRIEF DESCRIPTION OF THE DRAWINGS

The foregoing and other features of the present invention will become apparent to one skilled in the art to which the present invention relates upon consideration of the invention with reference to the accompanying drawings, wherein.

DETAILED DESCRIPTION OF THE PREFERRED EMBODIMENTS

An embodiment of the connector apparatus in accordance with the present invention will be described by referring to FIGS. 1 through 5.

Figure 1:
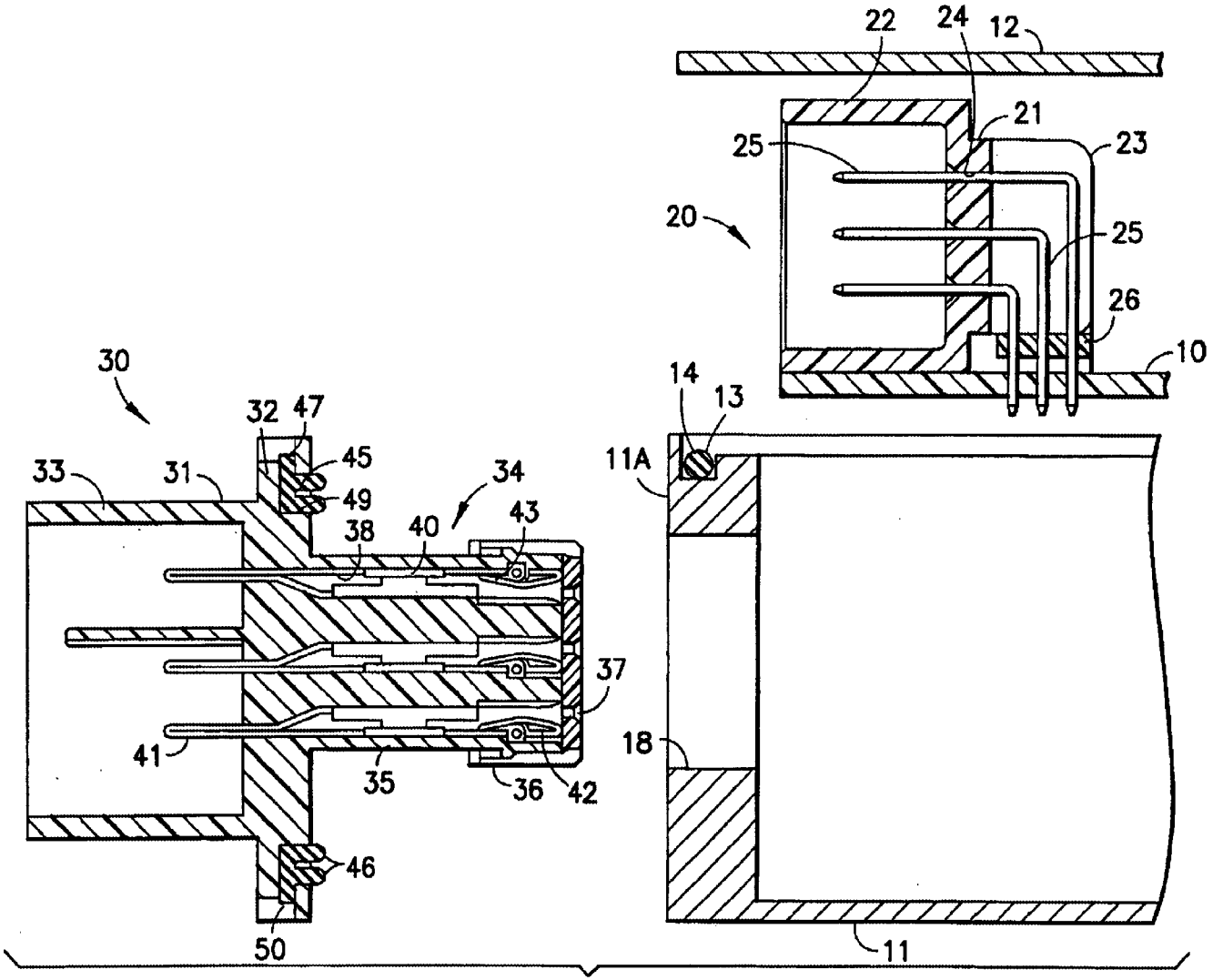
FIG. 1 is an exploded longitudinal sectional view of an embodiment of a connector apparatus for hardware in accordance with the present invention.

This embodiment exemplifies a watertight type connector apparatus. As shown in FIG. 1, the connector apparatus generally includes a casing 11 containing a printed board 10, a PCB connector 20 mounted on the printed board 10, and a relay connector 30 fitted in the PCB connector 20. The relay connector 30 extends outwardly from a sidewall of the casing 11 to be coupled to a mating connector (not shown).

Figure 4:
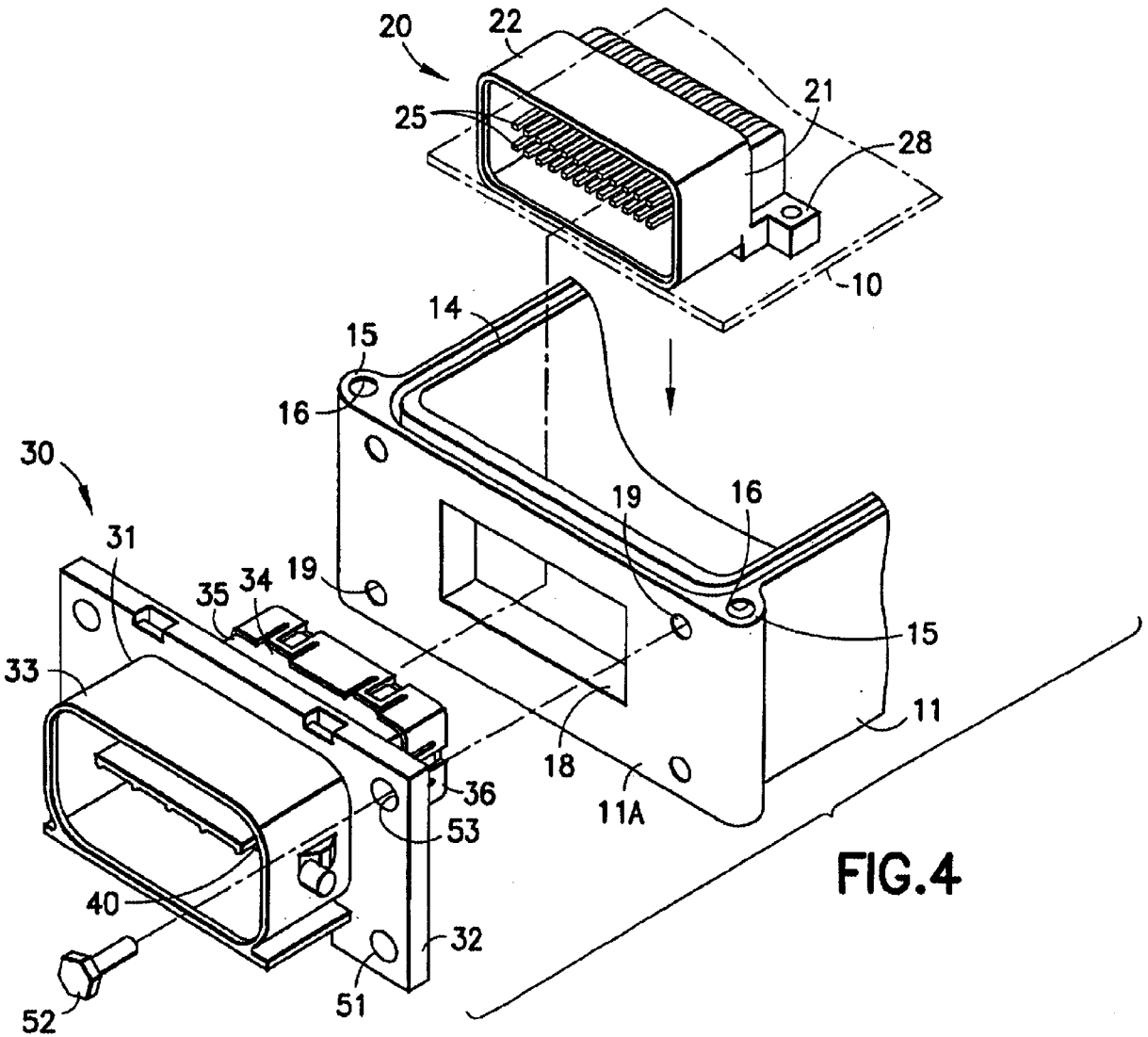
FIG. 4 is an exploded perspective view in the connector apparatus shown in FIG. 1, 1illustrating an assembling process.

The casing 11 is made of aluminum and is formed into a box-like configuration in which the topside is open to permit the printed board 10 to pass, as shown in FIG. 4. A lid plate 12 is mounted detachably on the topside of the casing 11. The casing 11 is provided on an upper end with a receiving groove 14 in which a seal ring 13 is mounted. The casing 11 also is provided at the four corners with attachment portions 15 having screwed bores 16 in the topside. The lid plate 12 can be secured to the casing 11 at the four corners by screws.

A laterally elongated attachment hole 18 is formed in a sidewall 11A of the casing 11. Screwed bores 19 are formed in the sidewall 11A outside the four corners of the attachment hole 18.

Figure 2:
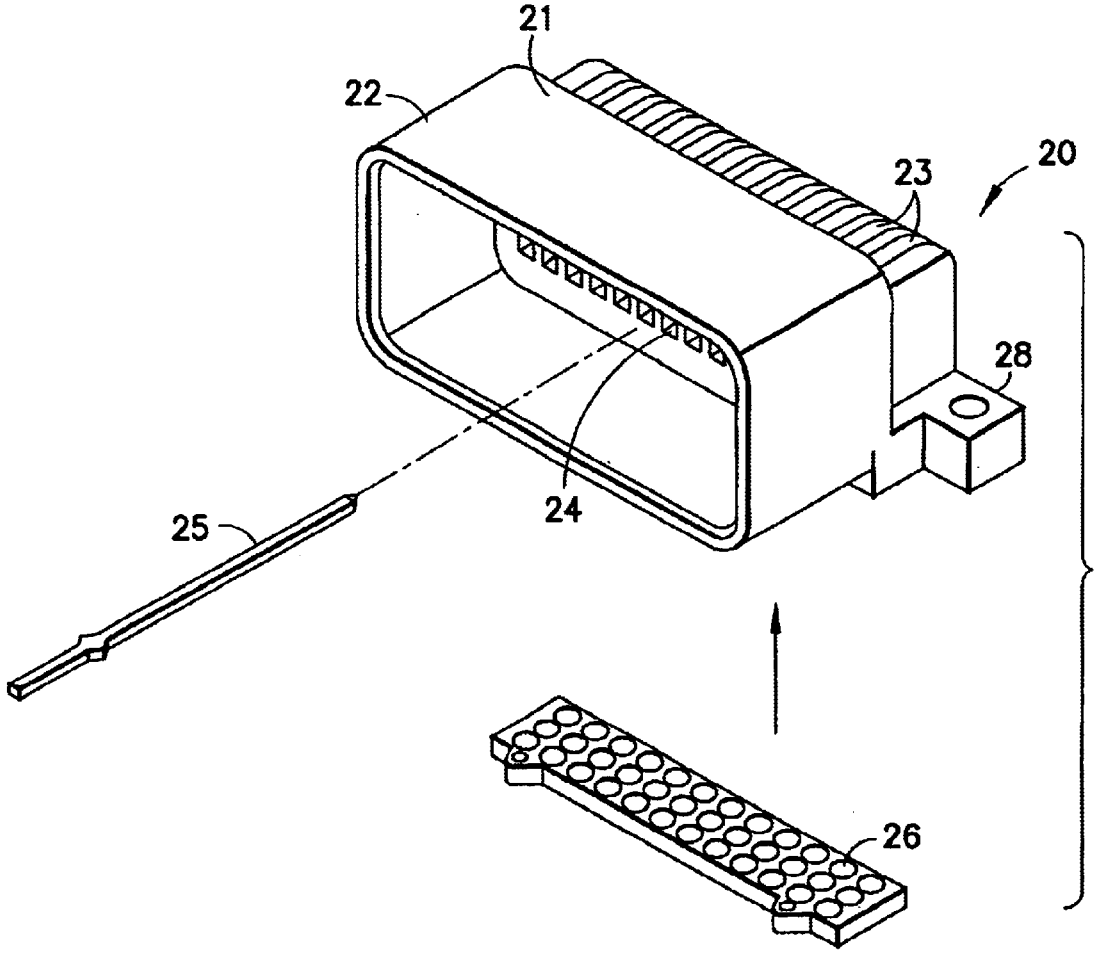
FIG. 2 is an exploded perspective view of a PCB connector in the connector apparatus shown in FIG. 1.

The PCB connector 20 includes a connector housing 21 made of a synthetic resin material. The connector housing 21, as shown in FIG. 2, includes a hood 22 open at the front side and a plurality of vertical partitions 23 on the rear side of the hood 22. As shown in FIG. 1, a plurality of terminal receiving ports 24 are arranged in three layers vertically in the inner part of the hood 22. Terminals 25 are inserted through the front side of the hood 22 into the terminal receiving ports 24. A distal end of each of the terminals 25 arranged in the vertical three layers passes through the terminal receiving port 24 to extend between the partitions 23 and turns down at right angle and at different distances spaced from the rear side of the hood 22 to pass through an alignment plate 26. Thus, the distal ends of the terminals 25 arranged in the vertical three layers are arranged horizontally in three rows under the alignment plate 26 (see FIG. 1).

As described above, the PCB connector 20 having the terminals 25 is mounted on a given edge area of the printed board 10 with the hood 22 being directed forward. Attachment portions 28 (see FIG. 4) provided on the opposite sides of the partitions 23 of the PCB connector 20 are secured to the printed board 10 by screws. At the same time, the distal ends of the terminals 25, which are directed downward, pass through the printed board 10 and are soldered to corresponding electric circuits arranged on the bottom surface of the printed board 10 to complete electrical connection.

Figure 3:
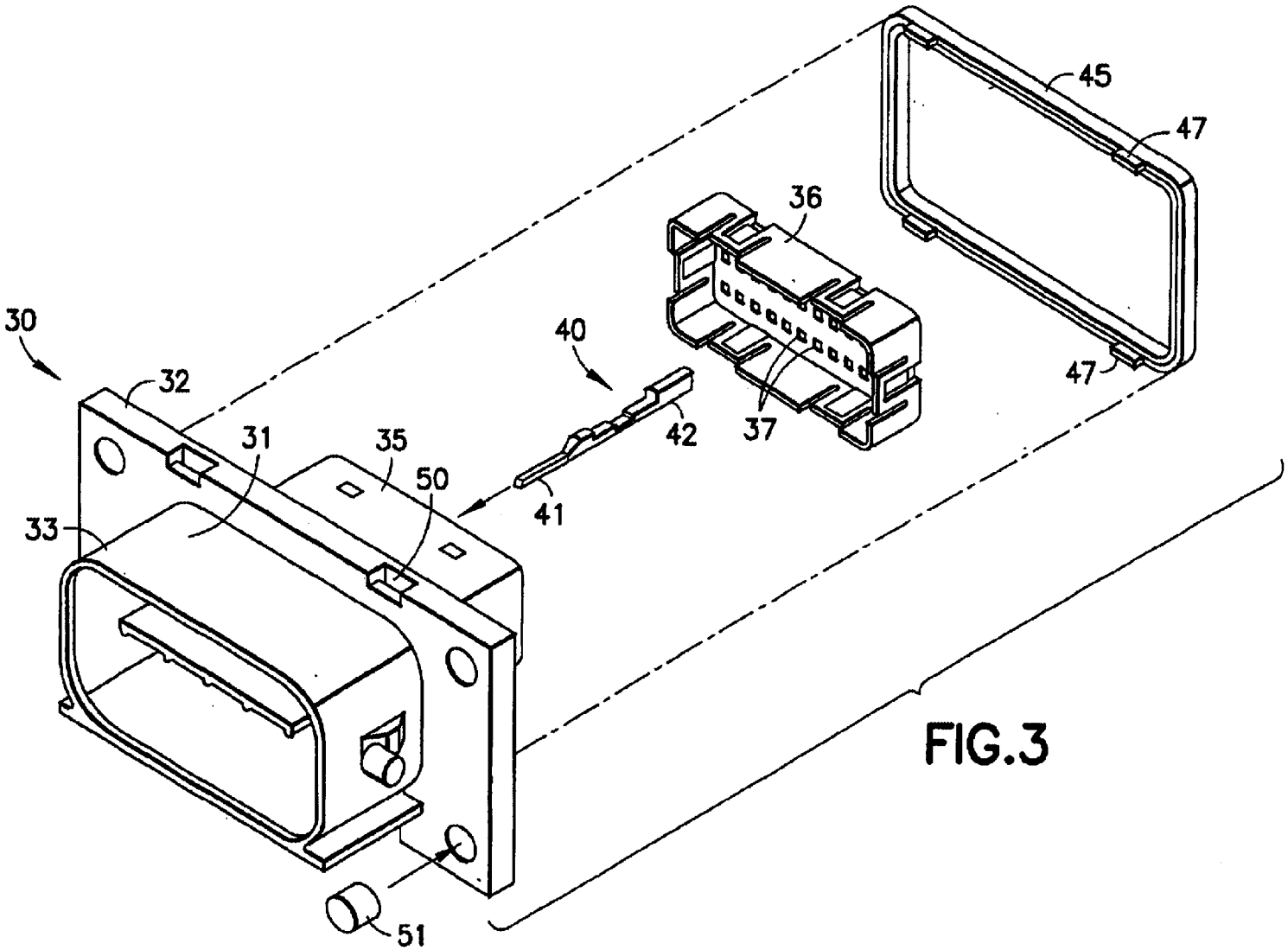
FIG. 3 is an exploded perspective view of a relay connector in the connector apparatus shown in FIG. 1.

The relay connector 30 includes a connector housing 31 made of a synthetic resin material. As shown in FIG. 3, the connector housing 31 has an attachment plate 32 adapted to contact a front side of the sidewall 11A of the casing 11 to cover the attachment hole 18. The attachment plate 32 is provided on the front side with an outer connector section 33 that has a hood-like configuration and is adapted to engage a mating connector. The attachment plate 32 is provided on the rear side with an inner connector section 34 adapted to engage the hood 22 of the PCB connector 20.

The inner connector section 34 includes a tower 35 and an end cap 36. The inner connector section 34 is inserted into the casing 11 through the attachment hole 18 from the front side. A given clearance is defined between the tower 35 and the attachment hole 18.

Cavities 38 are provided in the tower 35 of the connector housing 31 to contain the relay terminals 40. The cavities 38 are arranged to be opposed to ends of the terminals 25 extending in the hood 22 of the PCB connector 20.

The relay terminal 40 is provided on a longitudinal end with a tab-like male connection portion 41 and on the other end with a square tube-like female connection portion 42 that contains a contact piece 43 adapted to engage the terminal 25 of the PCB connector 20.

The relay terminals 40 are inserted into the cavities 38 from the rear side and the male connection portion 41 is directed forward to the given position. The male connection portions 41 then extend in the outer connector section 33. At the same time, the end cap 36 is attached to the projection end of the tower 35 to prevent the relay terminals 40 from coming out of the cavities 38. The end cap 36 is provided with terminal insertion ports 37 that receive the ends of the respective terminals 25 of the PCB connector 20.

The attachment plate 32 is provided on the peripheral area of the rear side and has a receiving groove 49 adapted to mount a seal packing 45. The seal packing 45 has two lips 46 on the surface adapted to contact the peripheral edge of the attachment hole 18. Upper and lower ears 47 of the seal packing 45 are inserted into receiving slots 50 formed in the outer side surface of the receiving groove 49 to prevent the seal packing 45 from coming out of the receiving groove 49.

Bolt insertion holes 53 for bolts 52 are formed in the four corners of the attachment plate 32 at the position corresponding to the screwed bores 19 in the casing 11. Collars 51 are mounted on the bolt insertion holes 53.

A process of assembling the embodiment of the connector apparatus in accordance with the present invention will be described below.

The terminals 25 and alignment plate 26 are attached to the connector housing 21 in the PCB connector 20. The PCB connector 20 then is secured to the given edge area of the printed board 10 and the terminals 25 are connected to the corresponding electric paths by the manner described above.

On the other hand, the respective relay terminals 40 are inserted into the respective cavities 28 in the relay connector 30. The end cap 36 then is attached to the tower 35 to prevent the terminals 40 from coming out of the cavities 38 and the seal packing 45 is mounted in the receiving groove 49.

Figure 5:
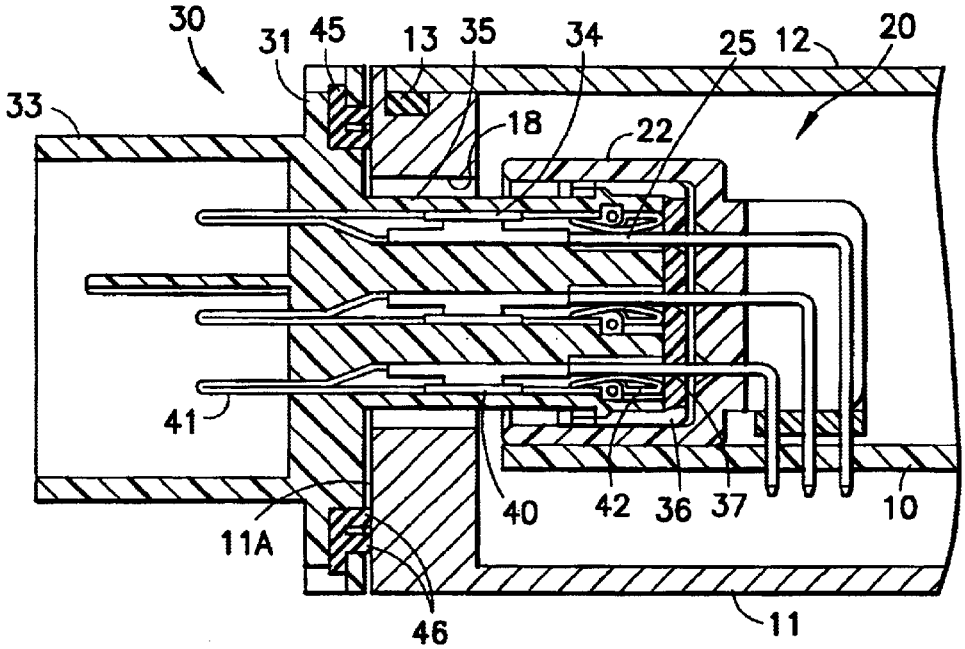
FIG. 5 is a longitudinal sectional view of the connector apparatus shown in FIG. 1 upon completion of the assembling process.
Figure 6:
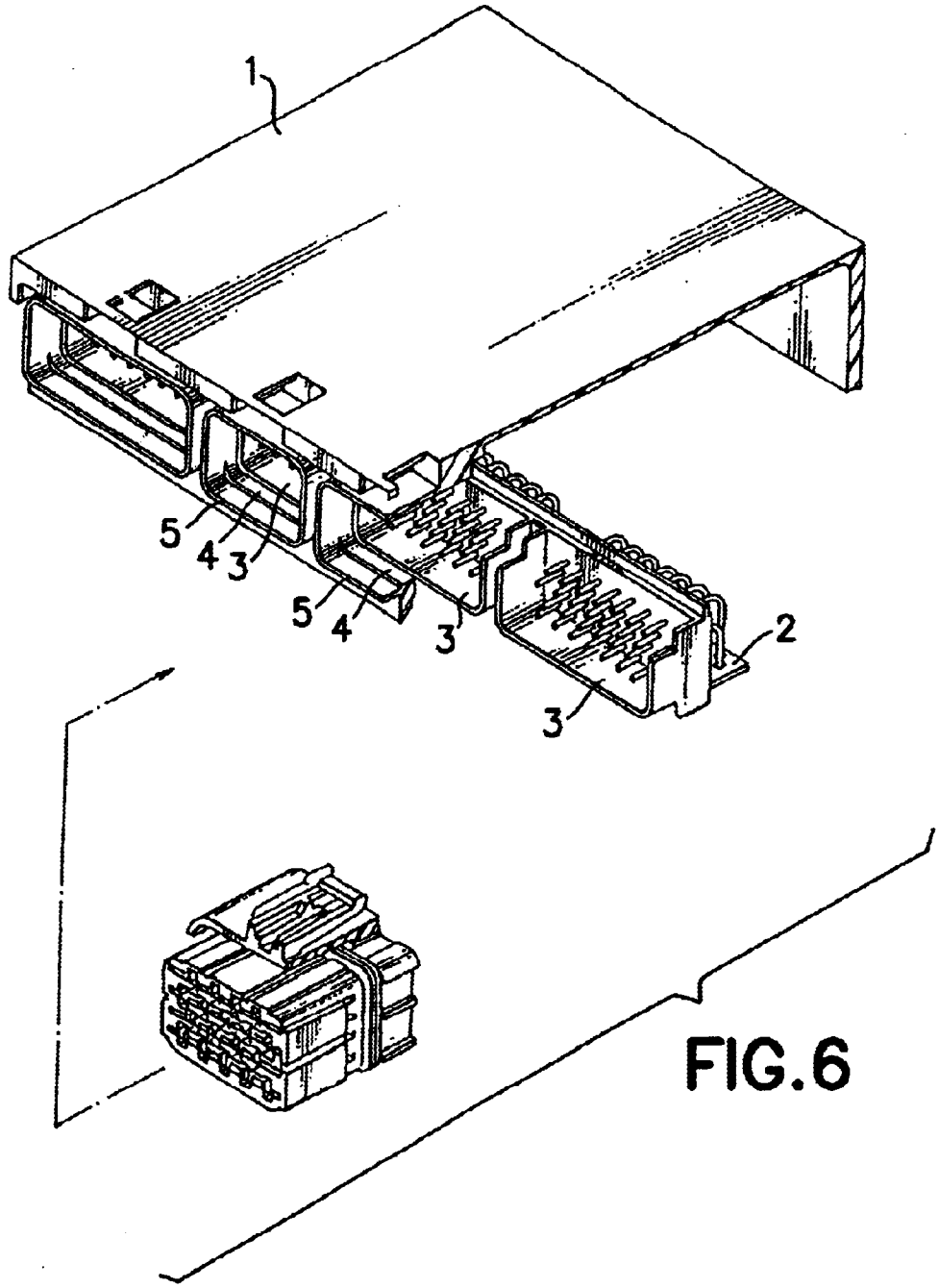
FIG. 6 is a perspective view of a conventional connector apparatus for hardware.

As shown in FIG. 4, the printed board 10 mounting the PCB connector 20 is inserted downward into the casing 11 to dispose the PCB connector 20 inside the attachment hole 18. The printed board 10 may be supported on a spacer or the like provided on the bottom surface of the casing 11. Next, the inner connector section 34 of the relay connector 30 is inserted into the casing 11 through the attachment hole 18. As shown in FIG. 5, the inner connector section 34 engages the hood 22 of the PCB connector 20. The ends of the terminals 25 of the PCB connector 20 are inserted into the female connection portions 42 of the corresponding relay terminals 40 through the terminal insertion ports 37 to form individual electrical connection. Since there is a given clearance between the inner connector section 34 of the relay connector 30 and the attachment hole 18, it is possible to couple the inner connector section 34 smoothly to the PCB connector 20 while moving the inner connector section 34 in the attachment hole 18.

The relay connector 30 is coupled to the PCB connector 20, and the attachment plate 32 of the relay connector 30 then is brought into contact with the sidewall 11A of the casing 11 to align the insertion holes 53 with the screwed bores 19. The relay connector 30 is secured to the sidewall 11A of the casing 11 by fastening the bolts 52 into the screwed bores 19 with the outer connector section 33 extending outwardly. The lips 46 of the seal packing 45 then are brought into close contact with the peripheral area around the attachment hole 18 while being squeezed, thereby forming a seal around the attachment hole 18.

The seal ring 13 is mounted in the receiving groove 14 in the casing 11. The lid plate 12 then is put on the casing 11 and secured to the casing 11 at the four corners by screws. The lid plate 12 covers the topside of the casing 11.

The process of assembling the connector apparatus is completed. Then, a mating connector (not shown) is coupled to the outer connector section 33 of the relay connector 30 that extends outwardly from the sidewall 11A of the casing 11 by utilizing a lever action exerted in connection with turning of a lever. A seal ring is mounted on the outer peripheral area of the mating connector. The seal ring is brought into close contact with the inner peripheral area of the outer connector section 33, thereby forming a seal between the relay connector 30 and the mating connector.

As described above, the casing 11 has a simple structure in which the attachment hole 18 is provided in the sidewall 11A. Therefore, the casing 11 can be made of a metallic material such as aluminum or the like that is effective in dissipation of heat. Also, the relay terminals 40 of the relay connector 30 are regularly connected to the terminals 25 of the PCB connector 20 beforehand and the mating connector is coupled to the outer connector section 33 of the relay connector 30 in which the relay terminals 40 are disposed. Therefore, it is possible to interconnect the corresponding terminals of the PCB connector 20 and mating connector through the relay terminals 40.

A clearance exists between the inner connector section 34 of the relay connector 30 and the attachment hole 18. As a result, it is possible to interconnect the PCB connector 20 and mating connector smoothly while displacing the inner connector section 34 in the attachment hole 18.

The present invention can be applied to a structure in which a plurality of PCB connectors are mounted on the printed board and the respective mating connectors are coupled to the respective PCB connectors individually. The present invention also can be applied to a non-watertight type connector apparatus.

From the above description of the invention, those skilled in the art will perceive improvements, changes and modifications. Such improvements, changes and modifications within the skill of the art are intended to be covered by the appended claims.

The entire disclosure of Japanese Patent Application No. 2001-216266 filed on Jul. 17, 2001 including specification, claims, drawings and summary is incorporated herein by reference in its entirety.

What is claimed is:

1. A connector apparatus for hardware, comprising:

a casing having a sidewall and an attachment hole in the sidewall, the casing further having an open top with a peripheral edge formed on the sidewall, a groove being formed in the peripheral edge and a seal being disposed in the groove;

a hardware side connector having terminals, the hardware side connector being inserted in said casing and being registered with said attachment hole;

a lid plate covering the open top and being sealingly engaged with the seal; and a relay connector having relay terminals, said relay connector being attachable in said sidewalls and having a first end with an inner connector section disposed through said attachment hole in said casing and adapted to fit said hardware side connector, said relay connector further having a second end with an outer connector section adapted to fit a mating connector, connection portions of said relay terminals extending into the outer connector section and being configured for connection with terminals of the mating connector.

2. The connector apparatus of claim 1, wherein said attachment hole has a clearance dimensioned to pass said inner connector section of said relay connector through said attachment hole.

3. The connector of claim 2, wherein the casing is made of a metallic material.

4. The connector of claim 3, wherein the metallic material is aluminum.

5. The connector of claim 1, further comprising a seal packing sealingly mounted around an outer periphery of the attachment hole.

6. The connector of claim 1, wherein the inner connector section of the relay connector is cross-sectionally smaller than the mounting hole, the relay connector further comprising an attachment plate that is cross-sectionally larger than the mounting hole, the attachment plate being formed with a groove disposed to align with portions of the sidewall surrounding the mounting hole, a seal packing being disposed in the groove for sealed engagement with the sidewall of the casing.

7. The connector of claim 1, wherein the hardware side connector is spaced inwardly from the sidewall of the casing, and wherein the inner connector section of the relay connector passes sufficiently through the mounting hole in the sidewall for connection to the hardware side connector.

* * * * *